US005315845A

United States Patent [19]

Lee

[11] Patent Number: 5,315,845

[45] Date of Patent: May 31, 1994

[54] COOLING WATER STORAGE TANK OF A REFRIGERATOR

[75] Inventor: Chang B. Lee, Suweon, Rep. of Korea

[73] Assignee: Samsung Electronics Co., Ltd., Suwon, Rep. of Korea

[21] Appl. No.: 859,050

[22] Filed: Mar. 27, 1992

[30] Foreign Application Priority Data

Apr. 17, 1991 [KR] Rep. of Korea ..... 91-5320

[51] Int. Cl.[5] ..... F25D 23/12

[52] U.S. Cl. ..... 62/338; 62/389; 165/170; 165/172

[58] Field of Search ..... 62/389, 338, 339; 165/170, 172

[56] References Cited

U.S. PATENT DOCUMENTS

| | | | |
|---|---|---|---|
| 3,511,415 | 5/1970 | Crowe | 62/339 |
| 3,834,178 | 9/1974 | Pink | 62/339 |
| 4,303,060 | 12/1981 | Mart | 165/170 |
| 4,739,629 | 4/1988 | True | 62/389 |

*Primary Examiner*—Ronald C. Capossela

*Attorney, Agent, or Firm*—Burns, Doane, Swecker & Mathis

[57] ABSTRACT

A water storage tank for use inside of a refrigerator comprises a one-piece molded plastic body forming a serpentine water conduit. The conduit includes a plurality of upright passageways fluidly interconnected at their ends. A plurality of water circulation passages interconnect the upright passageways intermediate their upper and lower ends to promote an internal circulation of stored water. The body includes a web structure which interconnects the upright passageways to conduct heat therebetween and resist rupture of the tank.

14 Claims, 2 Drawing Sheets

COOLING WATER STORAGE TANK OF A REFRIGERATOR

BACKGROUND OF INVENTION

The present invention relates to a water storage tank of a refrigerator for providing cool water, and more particularly to a cool water storage tank of a fresh food compartment refrigerator to provide cool water as well as to prevent the water stored therein from freezing.

PRIOR ART

Conventionally, a refrigerator stores cool water in the fresh food compartment. Thus, in a side-by-side type of refrigerator the water tank, which is made of plastic, is located in the vicinity of a bottom rear wall inside of the refrigerator. The water storage tank is connected to an operator on the exterior of a door to provide cool water. However, since the storage tank is at the bottom of a fresh food compartment whose temperature often falls below freezing, the storage tank can be destroyed by the freezing of the water stored therein.

To solve this problem, U.S. Pat. No. 4,739,629 discloses a water storage tank for use in the fresh food compartment of refrigerator.

This patent discloses a water storage tank with a serpentine shaped hollow body having a first straight section, a second straight section, a third straight section and a fourth straight section, which are parallel to each other.

The first section has an inlet at the top end and the fourth section has an outlet at the top end. The bottom of the first section is connected to the second section by a U-shaped curved section, the second section and third section are connected at the top by a U-shaped curved section, the third section and fourth section are connected at the bottom by a U-shaped curved section.

The four straight sections are interconnected at the top thereof with air flow passageways. The first air passageway extends from the first section to the top U-shaped curved section. Between the top U-shaped curved portion and the top end of the fourth straight section is another air passageway so that the water supply smoothly flows through the water storage tank.

Additionally, the U-shaped curved sections have the internal curvature area in the shape of a teardrop which can readily been seen having a wider radius in each of the internal curvature areas relative to a straight sided reverse curvature, whereby increased surface area is provided in the curved sections so that in the event water in the tank freezes, the material forming the internal curvature area will stretch sufficient to prevent rupture of the walls of the water storage tank.

In addition, the second straight section and the third straight section may separate or diverge from each other in a direction away from the top U-shaped curved section and thus again relieve the force exerted on the water tank by the frozen water contained therein.

The lateral cross-sections of the straight sections are polygonal in shape and in the preferred embodiment the polygon is a hexagon. Thus, with a plurality of relatively straight sides, when the water in the tank freezes, the relatively straight sides will bow outwardly and approach a circular configuration as viewed in cross-section to relieve the internal stress caused by the expended frozen water which prevents rupture of the water storage tank. The storage tank is secured to the rear wall of the fresh food compartment and for this purpose there is a storage tank support means which may be in the form of a U-shaped channel having a base and two spaced apart legs which terminate as inwardly directed flanges, respectively.

This water storage tank has at least one securing member located at the bottom of at least one of the U-shaped curved sections. The securing member cooperates with the support means to allow relative movement between the sections and to secure the water storage tank to the fresh food compartment.

However, this water storage tank traps water in the first straight section, the second straight section, the third straight section and the fourth straight section which freeze. Especially, when the water of the first section freezes, or when the water freezes at bottom of each section, water cannot be supplied so there is a problem in the reliability of the tank.

Additionally, since the water freezes at the bottom of each section and water which is not frozen may stay in the tank a long time, the freshness of the water may be reduced or the water may become contaminated so that the possibility of various water-borne diseases to users may occur.

Additionally, the water storage tank is a cross-sectional hexagonal shape with a curvature structure including a teardrop shaped area, so that it is difficult to mold in a single unit and needs separate components for forming the air passageway. In other words, the structure is very complicated.

Accordingly, it is an object of the invention, to provide a cool water storage tank of a refrigerator including a single hollow body which overcomes the drawbacks of the prior art structure.

It is a further object of the invention to provide a cool water storage tank which is molded in a single curvature shaped unit.

It is still a further object of the invention to provide a single unit cool water storage tank of a single unit which does not require separate components for an air passageway and for supporting itself at the proper place.

SUMMARY OF INVENTION

The present invention may be described as a body having a water inlet and outlet. A plurality of water storage passageways having a curvature shape are used. Water cycling passageways control at least a two step water level between adjacent passageways A water auxiliary passageway forms near to the water inlet from a middle part of the body to a top part. An air passageway is connected to the water cycling passageway and formed at the top end to smoothly provide water into the water inlet. A body support means extends from predetermined places on the outside of the body.

Accordingly, the invention forms a water passageway with a water level difference wherein curvature shaped storage passageways are linked to each other in a single body. Thus, water is stored in a tank with a single cavity at the same level. Additionally, it is possible to be molded into a single compact body.

BRIEF DESCRIPTION OF DRAWINGS

The present invention will be described in detail with respect to the accompanying drawings; in which.

DETAILED DESCRIPTION OF INVENTION

Figure 1:
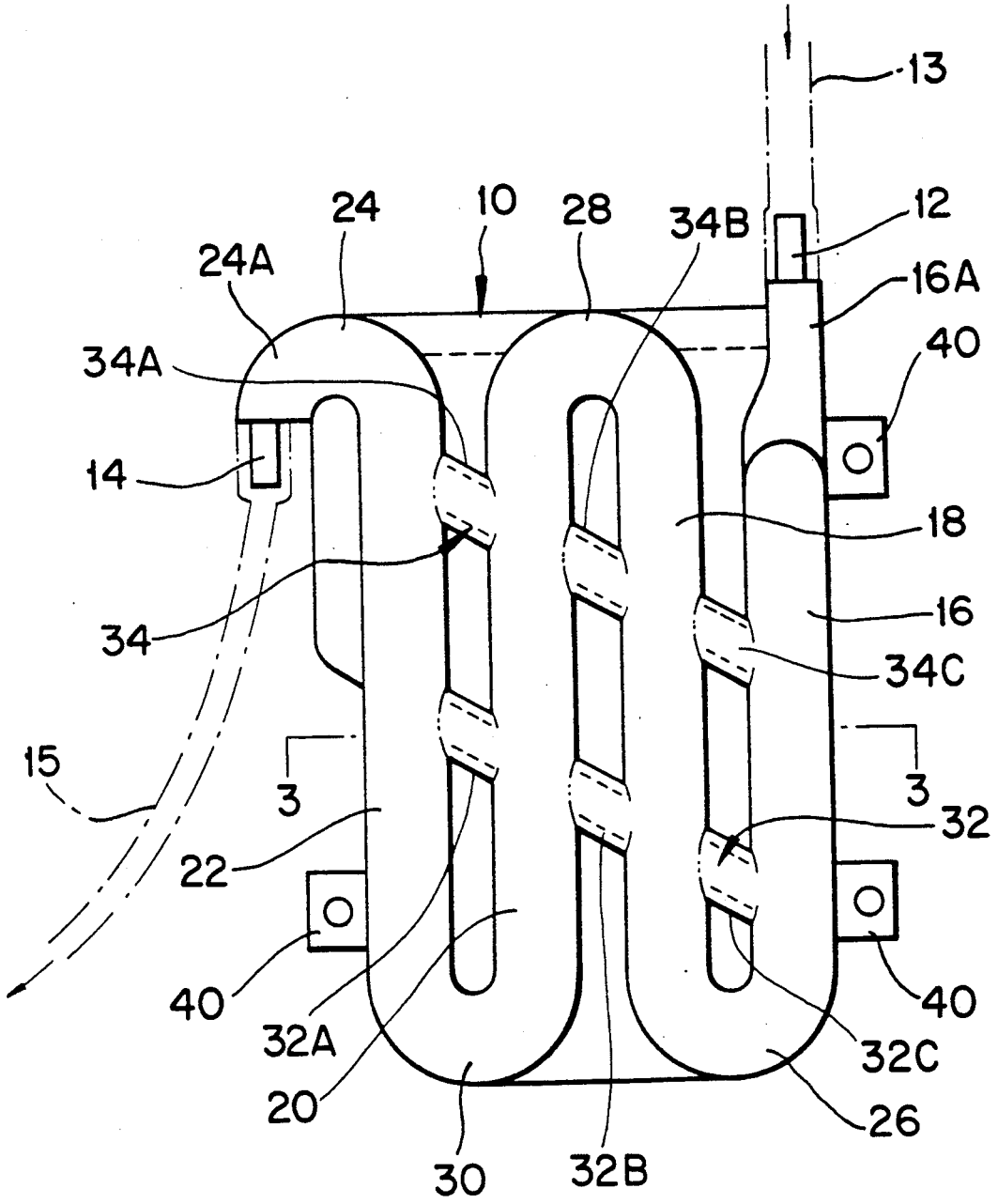
FIG. 1 is a perspective view showing a cooling water storage tank according to the present invention.

Referring to the drawings, a water storage tank 10 is a single molded body unit made of plastic materials.

FIG. 1 illustrates the water storage tank with a water inlet 12 extends upward in use and is positioned at the top side. A water outlet 14, which extending downward in use, is positioned at the top of one of the opposite side. The water inlet 12 and the water outlet 14 have hoses 13 and 15 linked to a corresponding water outer facet and to a water supply, respectively.

Between the water inlet 12 and the water outlet 14 are a plurality of curved water storage passageways 16, 18, 20 and 22 for conducting water and for storing water therein.

In the water storage passageways, passageway 16 includes at its top portion 16A, the water inlet 12. The passageway 22 includes at its top portion 24A, the water outlet 14.

The water storage passageways 16 to 22 are respectively connected to one another through a U-shaped passageway, which may be integrated with any water passageway at the upper portion or lower portion of the body. The water storage passageways 16 and 18, 18 and 20 or 20 and 22 are respectively connected by means of the U-shaped passageway 26, 28, and 30 to each other.

Additionally, the U-shaped passageway 28 and the water passageway 24 are connected to each other by an air passageway 31. In use water flows from the water inlet 12 into the passageways and U-shaped pipe and is readily stored in the water storage passageways and the U-shaped pipe.

The water storage tank 10 of the invention provides a storage tank function with its interior being a single cavity.

Between the water storage passageways 16, 18, 20 and 22, two sets of terraced water passages 32 and 34 are arranged in parallel so that stored-water is maintained in almost the same level at a predetermined height.

The first set 32 of water circulation passages is disposed above the second set and includes three mutually aligned passages 32A, 32B, and 32C. The circulation passage 32A interconnects the third and fourth upright passageways 20, 22; the circulation passage 32B interconnects the third and second upright passageways 20, 18; the circulation passage 32C interconnects the second and first upright passageways 18, 16. The second set 34 of circulation passages also includes three mutually aligned circulation passages 34A, 34B, 34C arranged similarly to the circulation passages 32A, 32B, 32C, respectively, but at a lower level. Each of the circulation passages 32A–32C and 34A–34C is disposed intermediate the upper and lower ends of the pair of upright passages to which it is connected, and is inclined downwardly toward the upstream one of that pair of upright passageways.

Hence, in relation to the water storage passageway 16, 18, 20 and 22, the water passageways 32 and 34 equalize the pressure of the passages according to the pressure of the water supply from the water inlet 12. Passageways 32 and 34 also operate as a water cycling passage at a predetermined water level. By their presence, the passageways 32, 34 promote an internal circulation of water within the tank 10, thereby aiding in preventing freezing which could otherwise be caused by water stagnancy.

In addition, an auxiliary passageway 36 is in fluid communication with the water outlet 14 to also supply water from passageway 22.

The water storage tank 10 also includes a web structure 38 which conducts heat between the water storage passages 16 to 20 and prevents circulating water from freezing. Also, the web structure supports the tank against rupture if the water does freeze.

Figure 2:
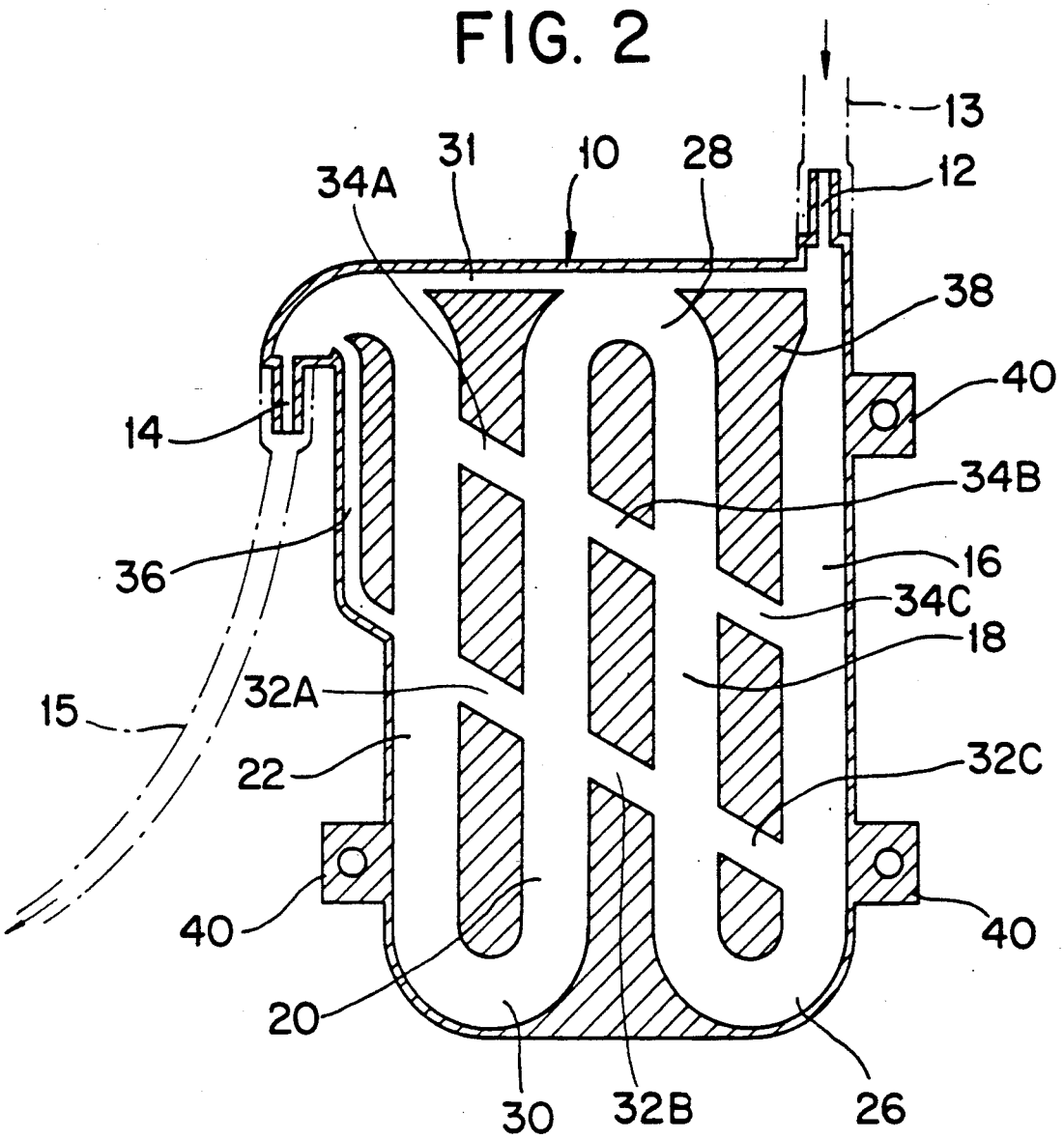
FIG. 2 is a side cross sectional view of FIG. 1.
Figure 3:
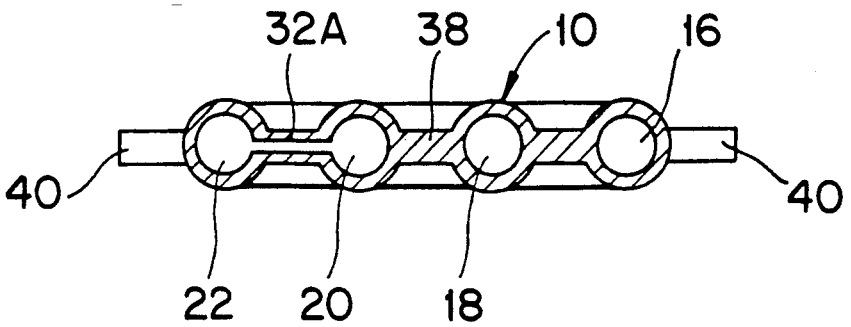
FIG. 3 is a cross sectional view taken along Line 3—3 of FIG. 2.

Additionally, the water storage tank 10 includes extension parts 40 which protrudes from a predetermined position on the tank 10 (see FIGS. 2 and 3) to enable the tank to be mounted to the fresh food compartment of a refrigerator.

The water storage tank 10 is preferably constructed as a single unit.

Having described preferred embodiments of the invention with reference to the accompanying drawings, it is to be understood that the water storage tank of the present invention stores water and prevents freezing of the stored-water and is strong enough to resist rupture.

What is claimed is:

1. A water storage tank for a refrigerator, comprising a body integrally molded as one unit; said body forming a serpentine water conduit having opposite ends defining an inlet and an outlet, respectively; said water conduit including:

at least three fluidly interconnected upright passageways, a pair of said upright passageways being fluidly interconnected at their upper ends; and a water circulation passage fluidly interconnecting said pair of upright passageways at a level below said upper ends thereof to promote an internal circulation of stored water within said tank.

2. A water storage tank according to claim 1, wherein said water circulation passage is inclined downwardly toward an upstream one of said pair of upright passageways.

3. A water storage tank according to claim 1, wherein said passage constitutes a first water circulation passage; a second water circulation passage interconnecting said pair of upright passageways at a location below said first water circulation passage.

4. A water storage tank according to claim 1, wherein a lower end of one of said pair of upright passageways is fluidly connected to a lower end of a third of said upright passageways; an additional water circulation passage fluidly interconnecting said one of said pair of upright passages and said third at a level above said lower ends thereof.

5. A water storage tank according to claim 4, wherein said water circulation passages are aligned with one another.

6. A water storage tank according to claim 5, wherein each of said water circulation passages is inclined downwardly toward the downstream one of the upright passages to which it is connected.

7. A water storage tank according to claim 1, wherein said body includes an integrally molded web structure interconnecting said three upright passageways for conducting heat therebetween and resisting rupture of said body.

8. A water storage tank according to claim 1, wherein said outlet is located at an upper end of one of said upright passageways, an auxiliary passageway fluidly interconnecting said outlet with a section of said one upright passageway at a level below said outlet.

9. A water storage tank according to claim 1, wherein said body includes an integrally molded fixing structure enabling said body to be mounted to a portion of a refrigerator.

10. A water storage tank according to claim 1, wherein said body is formed of plastic.

11. A water storage tank for a refrigerator, comprising a body integrally molded as one unit; said body forming a serpentine water conduit including:

first, second, third, and fourth upright passageways, said inlet and outlet formed at upper ends of said first and fourth upright passageways, respectively;

a first curved passage fluidly interconnecting lower ends of said first and second upright passageways;

a second curved passage fluidly interconnecting upper ends of said second and third upright passageways;

a third curved passage fluidly interconnecting lower ends ofsaid third and fourth upright passageways; and a set of water circulation passages fluidly interconnecting said first and second upright passageways, said second and third upright passageways, and said third and fourth upright passageways for promoting an internal circulation of water within said tank, said set of water circulation passages disposed at a level below the upper ends of said upright passageways.

12. A water storage tank according to claim 11, wherein said set of water circulation passages constitutes a first set; a second set of water circulation passages fluidly interconnecting said first and second upright passageways, said second and third upright passageways, and said third and fourth upright passageways; said second set being disposed at a level below said first set.

13. A water storage tank according to claim 11, wherein each water circulation passage is inclined downwardly toward a downstream one of the upright passages to which it is connected.

14. A water storage tank according to claim 11, wherein said body includes an integrally molded web structure interconnecting said upright passageways for conducting heat therebetween.

* * * * *